United States Patent [19]

Castiglioni

[11] Patent Number: 4,925,079

[45] Date of Patent: May 15, 1990

[54] APPARATUS FOR CORRECTLY FEEDING CONTINUOUS STRIPS WITH A SHAPED SIDE OUTLINE TO BLANKING MACHINES

[75] Inventor: Giovanni P. Castiglioni, Castellanza, Italy

[73] Assignee: F.I.C.I. Finanziaria Industriale Commerciale Immobiliare, Milan, Italy

[21] Appl. No.: 256,027

[22] Filed: Oct. 11, 1988

[30] Foreign Application Priority Data

Oct. 19, 1987 [IT] Italy ..... 22326 A/87

[51] Int. Cl.[5] ..... B65H 20/04

[52] U.S. Cl. ..... 226/152; 226/174; 226/178; 226/196; 226/199

[58] Field of Search ..... 226/174, 177, 181, 186, 226/187, 196, 199, 176, 45, 10, 24, 33, 42, 43, 120, 152, 199, 200

[56] References Cited

U.S. PATENT DOCUMENTS

| | | | |
|---|---|---|---|
| 2,250,138 | 2/1940 | Sheperdson | 226/196 X |
| 2,896,505 | 7/1959 | Nations | 226/43 X |
| 3,026,012 | 3/1960 | Clay | 226/199 X |
| 3,782,616 | 1/1974 | Surber, Jr. | 226/43 |
| 3,837,549 | 9/1974 | Sengewald | 226/43 X |
| 4,034,905 | 7/1977 | Lansmich | 226/95 X |
| 4,158,429 | 6/1979 | Ohmori | 226/34 |
| 4,341,155 | 7/1982 | Relyea et al. | 226/43 X |
| 4,420,107 | 12/1983 | Seyffert et al. | 226/174 X |
| 4,625,902 | 12/1986 | Billberg | 226/187 X |
| 4,771,928 | 9/1988 | Okada | 226/15 |

*Primary Examiner*—Stanley N. Gilreath
*Attorney, Agent, or Firm*—Diller, Ramik & Wight

[57] ABSTRACT

Apparatus for accurately feeding a continuous web having opposite generally sinuous longitudinal edges each defined by alternating convex and concave edge portions by utilizing a drive and idle roll for intermittently feeding the web in a predetermined direction, lateral generally C-shaped guides spaced a distance from each other corresponding to the distance between the longitudinal edges of the web, sensing elements located above elongated slots in upper arms of the webs for sensing along a line in chordal relationship to the convex and concave edge portions, and a mechanism responsive to the sensing elements for intermittently driving the drive roller to stepwise feed the web in the predetermined direction.

20 Claims, 3 Drawing Sheets

APPARATUS FOR CORRECTLY FEEDING CONTINUOUS STRIPS WITH A SHAPED SIDE OUTLINE TO BLANKING MACHINES

The present invention relates to an apparatus for correctly feeding continuous strips having sinusoidal shaped side or longitudinal edges to blanking machines.

In the processing of continuous strips having sinusoidal shaped side edges, of, e.g., a metal material, such as a metal sheet, the strips, after being obtained from continuous iron plate, and wound to form rolls, have to be fed to blanking or pressing machines, such as presses and the like, in order to obtain the end blanked or pressed material having the desired shape.

In general, this feed is easily accomplished without any particular problems when continuous iron plate having straight side edges parallel to each other are concerned. In fact, in this case, even a non-perfect feed, accomplished as a sequence of repeated stepwise progress steps, only determines a waste of scrap material.

The problem of a correct feed results to be of basic importance when the material consists of continuous strips with a shaped side outline, wherein the need exists for a nearly total absence of errors in positioning under the die of the blanking/pressing machine, in order to prevent that any processing wastes may be formed.

Feeding apparatuses of a type known from the prior art are constituted by simple rolls, or pairs of rolls, which drive the strips of continuous material in a calender-like fashion, charging them to the blanking/-pressing machines. The step-by-step progressing of the material is accomplished by controlling the drive motor, by means of a timer presettable as a function of the length of each individual progressing step.

Further feeder devices known from the prior art accomplish the step-by-step progressing of the strip of continuous material by means of the action of manipulator devices, such as of pad type, which sequentially grasp the strip, advance it over the predetermined length, release it, and finally return back to their initial position, in order to be able to grasp again the strip, so as to repeat the stepwise progressing cycle.

When, e.g., the strip is of a metal material, and has a side edge of sinusoidal configuration, and from it individual elements should be produced by blanking, which are essentially circular or oval in shape, there is the absolute need that the strip portions come under the die after each other in a perfectly trued position without any errors in positioning, in order to optimize the obtained product. In fact, an out-of-phase positioning in the longitudinal direction would lead to the production of a blanked element not trued relatively to the strip portion. The cummulative errors of out-of-phase positioning could lead to blanking being carried out along concave sides of the sinusoidal strip in which case the absence of strip material can result in incomplete blanked elements.

The above mentioned apparatuses and devices are not able to secure such a precision of progressing during the individual progressing steps, and of reproduction of the same progressing length; on the contrary, they tend to multiply any even very small errors which may occur. Furthermore, the apparatuses and devices of such types known from the prior art, both of the type with rolls, and of the type with manipulator elements, cause the generation of surface damage to the strip of material being processed, and are not capable of eliminating any stresses possibly existing in the same material before the blanking.

A purpose of the present invention is therefore to provide an apparatus for feeding continuous strips of a material to be processed by blanking/pressing, which is capable of eliminating any progressing errors, and is therefore capable of securing an always equal and correct positioning of the portion of strip to be blanked under the downstream blanking machine.

A further purpose is to provide a feeding apparatus which eliminates the formation of any defects on the surface of the material being progressed.

A further is that such a feeding apparatus can also operate at a high speed, without causing differential stepwise feeding of a strip.

The functional and structural characteristics and the advantages of an apparatus according to the present invention will be better understood from the following exemplifying and non-limitative disclosure, referred to the hereto attached diagrammatic drawings, wherein.

Figure 1:
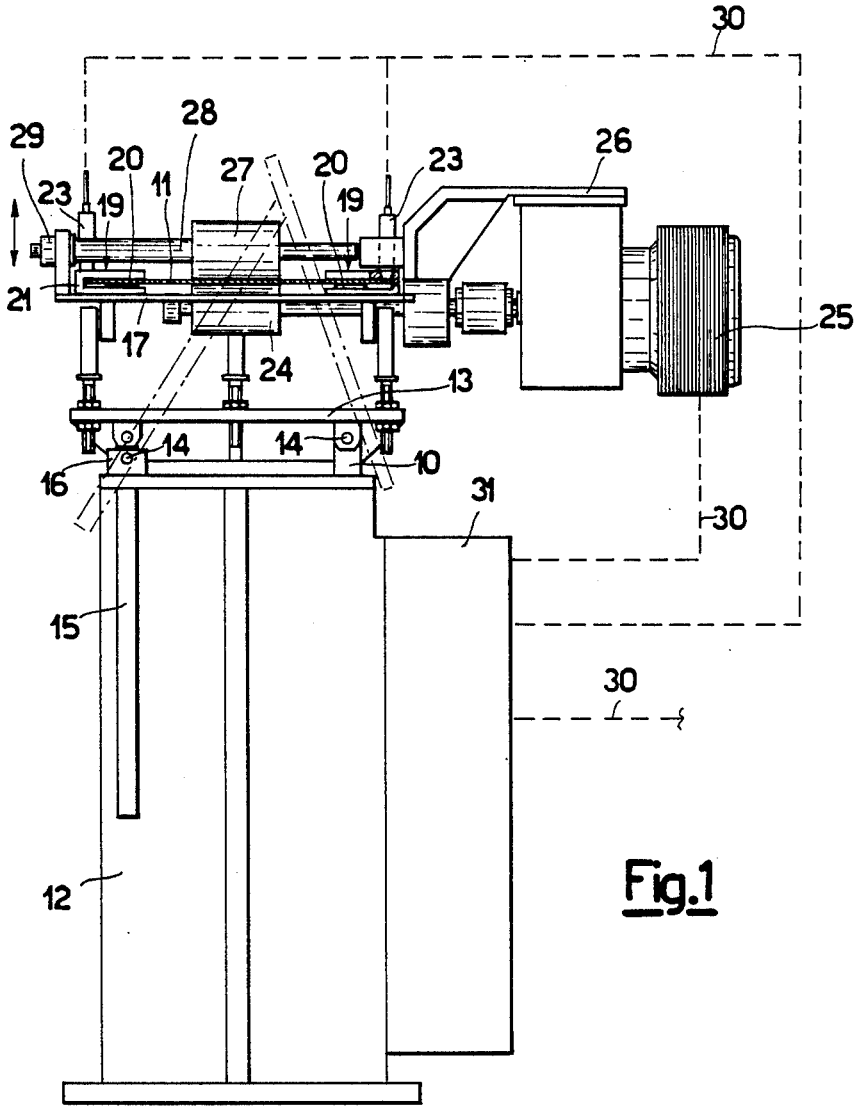
FIG. 1 is a schematic view showing a front elevational view of the apparatus according to the present invention.
Figure 2:
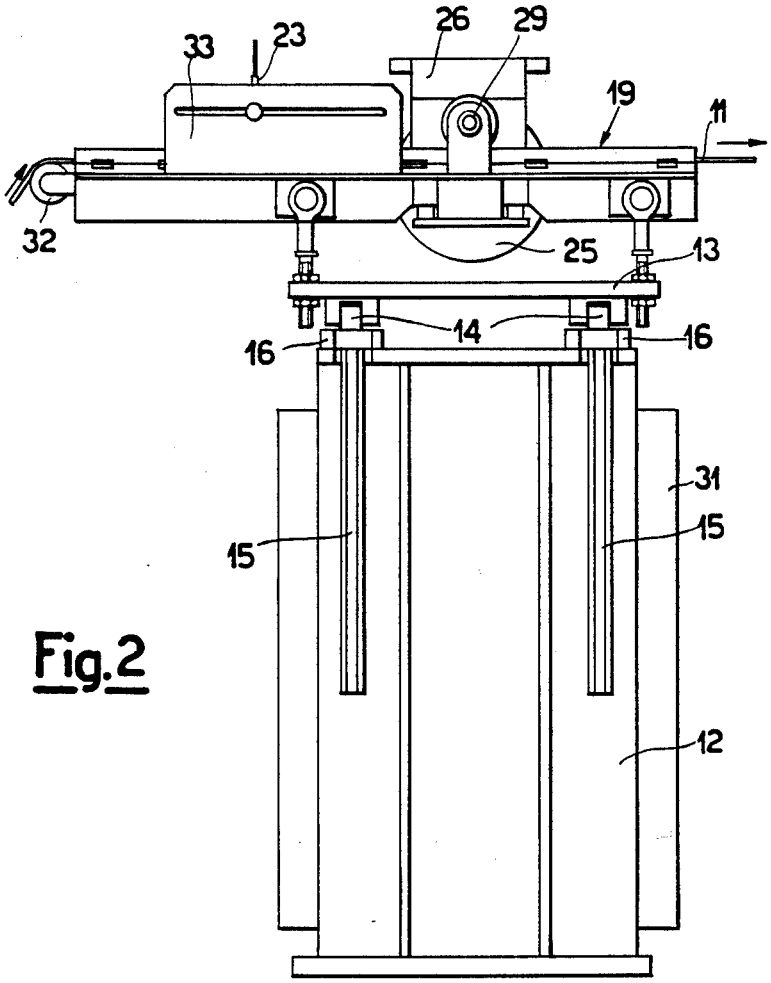
FIG. 2 is a schematic view showing a side elevational view of the apparatus of FIG. 1.
Figure 3:
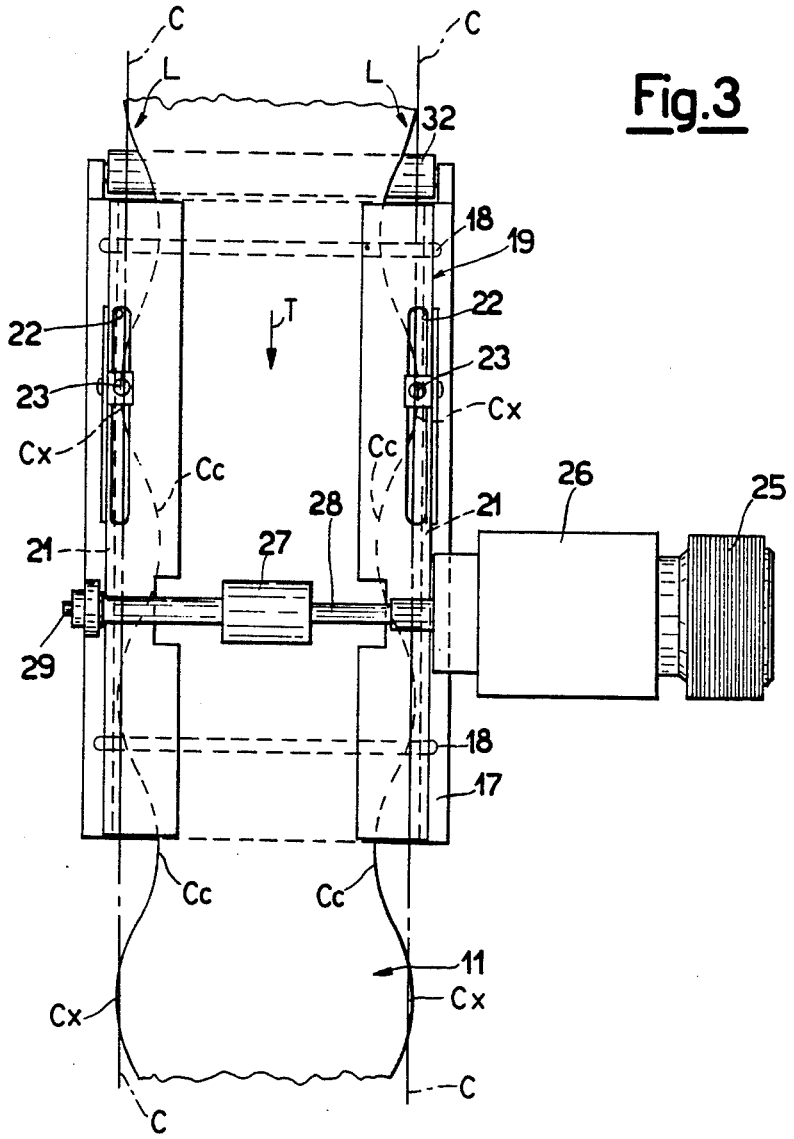
FIG. 3 shows a plan view of the apparatus shown in FIG. 1.

Referring to the drawings, an apparatus is illustrated for correctly feeding a continuous strip 11 having opposite longitudinal or side edges L of a sinusoidal configuration. Each longitudinal or sinusoidal edge L of the strip 11 is defined by alternating convex edge portions Cx and concave edge portions Cc. A chordal line C (FIG. 3) is associated with each of the sinusoidal longitudinal edges L for a purpose which will be described more fully hereinafter. The direction of travel of the strip 11 is designated by the headed arrow T in FIG. 3. The apparatus is installed at the inlet of a blanking or pressing machine (not shown) which receives the continuous sinusoidal strip 11 from an unwinding unit (also not shown), and blanks or blanking elements are formed from the strip 11 in a conventional manner.

The feeding apparatus comprises a framework consisting of a base 12, above which a support plane 13 is positioned, with hinge elements 14 being interposed between them. The support plane 13 can be tilted relatively to the base 12 thanks to the hinge elements 14, which can be respectively connected to rod elements 15, which can be moved by sliding inside respective slide and guide bushes 16 integral with the base 12, and such as to allow the rod elements 15 to slide, and to be locked in the desired position. In the depicted form of practical embodiment, such rod elements 15 are provided on one side only of the apparatus, whilst on the other side the hinge elements 14 are connected to bracket elements 10 extending on the top of the base 12.

Over the support plane 13, a further support plane 17 is provided, wherein restraint and side guide elements generally indicated by the reference numeral 19, for retaining and guiding said continuous strip 11, can be positioned along cross guide slots 18.

Said restraint and side guide elements 19 preferably have an essentially "C"-shaped cross section, are opposite to each other, and, on a lower portion thereof, are provided with a plurality of revolving elements 20, such as rollers, in order to support the opposite ends of the continuous strip 11. The upper portion of said restraint elements has, nearly in correspondence with the vertical wall 21, a longitudinal through-slot 22, through which a sensor element 23 acts, which is suitably supported—and adjustable in position—above a vertical plate 33 integral with said restraint and side guide elements 19. Each sensor or sensor element 23 is not only positioned generally adjacent each longitudinal slot or aperture 22, but is also positioned along the associated chordal line C such that one or the other or both of the sensors 23 will detect the presence and/or absence of the convex and/or concave edge portions Cx, Cc, respectively.

Transversely relatively to said further support plane 17 and to said restraint and side guide elements 19, a feed unit is positioned, which comprises a calender constituted by a lower roll 24 driven by means of a relevant motor means 25, suitably supported in 26 sideways and transversely to the further support plane 17. Coupled with, and opposite to, said lower roll 24, an upper roll 27 is positioned, which is freely rotatable on a respective shaft 28, and which, at an end 29 thereof, is adjustable in height relatively to the support plane 17, and consequently relatively to the lower roll 24, so that the calibration can be changed as a function of the thickness of the continuous strip 11 being fed.

The lower roll 24, e.g., a rubber roll, and the upper roll 27, e.g., a steel roll, constitute a pair of rolls interacting with each other, having such transversal dimensions as to occupy a minimum central portion of said continuous strip 11.

Both the motor means 25 and the sensor elements 23 are operatively connected by means of connecting lines 30 to a monitoring and control device 31 operatively connected, through a further line 30, to the drive means of the blanking machine (not shown in the figures), so as to correlate the operation thereof.

Preferably, at the inlet end of said further support plane 17, and transversely to said further support plate, an idle roller 32 for the continuous strip of material being fed is provided.

An apparatus according to the present invention operates as follows.

The continuous strip 11, having a shaped side outline, after being unwound and passed above the roller 32, installed at the inlet of the apparatus according to the invention, enters the restraint and side guide elements 19 supported in correspondence of longitudinal side portions by the rollers 20. The continuous strip 11 passes then through the pair of rolls 24 and 27, and, after exiting them, is fed to the blanking machine (not shown in the figures).

As stated, this feed has to be carried out in a stepwise fashion, so that under the die strip portions are brought, which are perfectly trued respectively to said die.

According to the present invention, this stepwise progressing is carried out by means of the pair of rolls 24 and 27, or, better, by means of the actuation of the motor means 25, controlled by at least one of the sensor elements 23, such as photocells, optical fibres, and so forth. As noted from FIG. 3, the sensor elements 23 are each positioned generally adjacent an associated longitudinal edge L of the strip 11 at a position along the chordal line C of the convex edge portions Cx and the concave edge portions Cc. Therefore, as the strip 11 travels in the direction T, one or the other or both of the sensor elements 23 will detect the presence and/or absence of the convex and/or concave edge portions Cx, Cc, respectively, and operate the motor means 25 in a stepwise fashion to step-advance the web or sheet 11 (or prevent operation of the motor means 25) which detect a predetermined height of the sinusoid, nearly in the nearby of the crest, or of the peak of said sinusoid.

In fact, the stop command to stop the revolution of the motor-driven roll 24 is given by the first one of said sensor elements 23 which detects the presence or absence of the convex and concave edge portions Cx, Cc, respectively, independently from the fact whether such a detection occurs in correspondence of the one side, or in correspondence of the other side, of the restraint and guide elements 19. In fact, it may occur that the fed continuous strip 11 is progressed in a position not perfectly aligned to the axis of the apparatus, or it may have a non-flat configuration, owing to stresses which were generated in the material when the strip was produced.

Advantageously, inasmuch as the pair of rolls 24 and 27 are of small size, and are such as to occupy a minimum central portion of the continuous strip 11, the strip is not obliged to progress according to a certain direction throughout its transversal surface, and, by interacting with the vertical walls 21 of the restraint and side guide elements 19, tends to arrange itself back according to the correct axis or direction of progressing. All this occurs precisely thanks to the fact that the action of the pair of feed rolls is limited to a minimum strip portion, and gives the same strip the possibility of correctly adapting or aligning again inside the apparatus.

The presence of the hinge elements 14, of the rod elements 15 and of the relevant slide and guide bushes 16, as well as of the bracket elements 10 makes it possible for the support plane 13 to be tilted, so that an apparatus according to the present invention can be positioned at the inlet of a blanking machine operating according to an inclined arrangement, so as to operate rapidly, allowing the blanked product to exit instantaneously, and the scrap material to be wound again.

The slotted cross guides 18 make it possible for the restraint and side guide elements 19 to be moved, so as to be approached to, and spaced apart from, each other, in order that they may be adjusted and adapted in position as a function of varying maximum transversal dimensions of the continuous strip to be fed.

Additionally and advantageously, in the event an apparatus according to the present invention has to be used for processing a continuous strip having mutually parallel straight edges, a simple turning off of the sensor elements, and the prearrangement of a detector means for detecting the strip length fed in the stepwise-progressing mode will make it possible the use change and the new operating mode of said apparatus to be accomplished immediately.

I claim:

1. Apparatus for accurately feeding a continuous web having opposite generally sinuous longitudinal edges each defined by alternating convex and concave edge portions comprising a pair of rolls defining a bight therebetween for passage therethrough of a web, said pair of rolls including a drive roll, means for driving said drive roll to thereby feed the web in a predetermined direction, means for guiding the web during the feeding thereof, said guiding means including opposite lateral guides spaced a distance from each other corresponding generally to the distance between transversely opposite convex edge portions of the web, means for sensing along a line in chordal relationship to the concave and convex edge portions of said opposite sinuous longitudinal edges to thereby sense the presence and/or absence of the concave and/or convex edge portions, and means responsive to said sensing means for selectively intermittently actuating said driving means whereby said drive roll stepwise feeds said web in said predetermined direction.

2. The web feeding apparatus as defined in claim 1 wherein said sensing means includes a sensor generally adjacent each of said lateral guides.

3. The web feeding apparatus as defined in claim 1 including means in each of said lateral guides forming an aperture therein, and said sensing means includes a sensor generally adjacent each of said lateral guides for sensing the presence and/or absence of the concave and/or convex edge portions through the adjacent aperture.

4. The web feeding apparatus as defined in claim 3 wherein each of said lateral guides is of a generally C-shaped configuration, said C-shaped lateral guides are disposed in facing opening relationship to each other, each C-shaped lateral guide being defined in part by upper and lower arms, and said apertures are located in said upper arms.

5. The web feeding apparatus as defined in claim 1 including means in each of said lateral guides forming an elongated aperture therein, and said sensing means includes a sensor generally adjacent each of said lateral guides for sensing the presence and/or absence of the concave and/or convex edge portions through the adjacent aperture.

6. The web feeding apparatus as defined in claim 1 including means in each of said lateral guides forming an aperture therein elongated in the predetermined direction of web feed, and said sensing means includes a sensor generally adjacent each of said lateral guides for sensing the presence and/or absence of the concave and/or convex edge portions through the adjacent aperture.

7. The web feeding apparatus as defined in claim 6 wherein said responsive means is responsive to at least a leading one of the concave edge portions of the longitudinal edges.

8. The web feeding apparatus as defined in claim 7 wherein each of said lateral guides is of a generally C-shaped configuration, and said C-shaped lateral guides are disposed in facing opening relationship to each other.

9. The web feeding apparatus as defined in claim 7 including means in each of said lateral guides forming an aperture therein, said sensing means includes a sensor generally adjacent each of said lateral guides for sensing the presence and/or absence of the concave and/or convex edge portions through the adjacent aperture, and means for adjusting the position of each sensor relative to its associated aperture.

10. The web feeding apparatus as defined in claim 1 including means in each of said lateral guides forming an elongated aperture therein, and said sensing means includes a sensor generally adjacent and above each of said lateral guides for sensing the presence and/or absence of the concave and/or convex edge portions through the adjacent aperture.

11. The web feeding aparatus as defined in claim 1 including means in each of said lateral guides forming an aperture therein, and said sensing means includes a sensor generally adjacent and above each of said lateral guides for sensing the presence and/or absence of the concave and/or convex edge portions through the adjacent aperture.

12. The web feeding apparatus as defined in claim 1 including means in each of said lateral guides forming an aperture therein elongated in the predetermined direction of web feed, and said sensing means includes a sensor generally adjacent and above each of said lateral guides for sensing the presence and/or absence of the concave and/or convex edge portions through the adjacent aperture.

13. The web feeding apparatus as defined in claim 1 wherein said responsive means is responsive to at least a leading one of the concave edge portions of the longitudinal edges.

14. The web feeding apparatus as defined in claim 1 wherein said responsive means is responsive to at least a leading one of the concave edge portions of the longitudinal edges for deactivating said drive means.

15. The web feeding apparatus as defined in claim 1 wherein said lateral guides include support portions for underlyingly supporting the web, and means for tilting at least one of said lateral guides about an axis parallel to the predetermined direction of web feed whereby the web is fed in a position tilted to the horizontal.

16. The web feeding apparatus as defined in claim 1 wherein each of said lateral guides is of generally C-shaped configuration, and said C-shaped lateral guides are disposed in facing opening relationship to each other.

17. The web feeding apparatus as defined in claim 1 wherein each of said lateral guides is of a generally C-shaped configuration, said C-shaped lateral guides are disposed in facing opening relationship to each other, and rotatable elements carried by said lateral guides in underlying supporting relationship to the web longitudinal edges.

18. The web feeding apparatus as defined in claim 1 wherein each of said lateral guides is of a generally C-shaped configuration, said C-shaped lateral guides are disposed in facing opening relationship to each other, each C-shaped lateral guide being defined in part by upper and lower arms, and rotatable elements carried by said lower arms in underlying supporting relationship to the web longitudinal edges.

19. The web feeding apparatus as defined in claim 1 including means in each of said lateral guides forming an aperture therein, said sensing means includes a sensor generally adjacent each of said lateral guides for sensing the presence and/or absence of the concave and/or convex edge portions through the adjacent aperture, and means for adjusting the position of each sensor relative to its associated aperture.

20. The web feeding apparatus as defined in claim 1 including a support common to and underlyingly supporting said lateral guides, said common support having opposite lateral sides, means for pivoting one of said common support lateral sides about an axis parallel to the predetermined direction of web feed, and means for generally vertically slidably supporting another of said common support lateral sides whereby the web is fed in a position tilted to the horizontal.

* * * * *